United States Patent [19]

Braddick

[11] 3,999,605

[45] Dec. 28, 1976

[54] WELL TOOL FOR SETTING AND SUPPORTING LINERS

[75] Inventor: Britt O. Braddick, Houston, Tex.

[73] Assignee: Texas Iron Works, Inc., Houston, Tex.

[22] Filed: Feb. 18, 1976

[21] Appl. No.: 658,915

[52] U.S. Cl. ..... 166/212

[51] Int. Cl.[2] ..... E21B 23/00

[58] Field of Search ..... 166/212, 216, 217, 120, 166/121, 122, 137, 138, 140

[56] References Cited

UNITED STATES PATENTS

| | | | |
|---|---|---|---|
| 2,328,840 | 9/1943 | O'Leary | 166/120 |
| 2,467,801 | 4/1949 | Baker | 166/120 |
| 3,223,170 | 12/1965 | Mott | 166/212 |

*Primary Examiner*—James A. Leppink
*Attorney, Agent, or Firm*—Jack W. Hayden

[57] ABSTRACT

A tubular member or mandrel is provided with an outer housing and a cone shaped enlargement. Segmented cone means is slidably supported on the mandrel between the mandrel and the outer housing and the mandrel includes a portion spaced radially therefrom to define an annular cylinder with the outer housing having a piston portion sealably fitting within the annular cylinder. Slip segments are provided on the outer housing. Port means are provided in the mandrel for communicating fluid pressure to act on the housing piston portion in the annular cylinder, and shear means connect the outer housing and mandrel to restrain relative longitudinal movement therebetween, such shear means being releasable when a predetermined fluid pressure is applied to the housing piston portion so that longitudinal movement of the outer housing relative to the mandrel may be effected to engage the slip segments with the segmented cone means and the cone shaped enlargment to radially expand the slip segments into gripping relationship with a well bore casing.

5 Claims, 6 Drawing Figures

WELL TOOL FOR SETTING AND SUPPORTING LINERS

SUMMARY OF THE INVENTION

The use of an arrangement including slips and a cone shape enlargement for urging the slips radially is well known and has been used for a number of years in various oil tools to position them in casing or tubing. It can be appreciated that the amount of radial expansion of the slip segments is limited by the size of the cone shaped member or enlargement which engages the slip segments and urges them radially outwardly and by the size of the tubing or casing through which the arrangement must be moved.

Thus, the radial expansion of the slips is limited since the slips as well as the cone shaped enlargement for engaging therewith to urge them radially outwardly must be of proper size to readily move through a well string without fear of hanging up the slips or the cone shaped enlargement within such well string.

In some instances it may be desirable to set the slips in a portion of a well bore which is of substantially larger diameter than the well bore casing through which the slips and cone shaped enlargement are initially moved. At the present time so far as known to applicant, the size of the well bore casing through which the setting tool is moved has heretofore limited the amount of radial expansion of the slips, and thus precluded setting a slip type hanging arrangement, such as employed in hanging a liner in a well bore casing, from being used in a larger receptacle positioned below the well string through which the slip segments and cone shaped enlargements are lowered.

The present invention overcomes this in that it provides an arrangement which can be moved through a well string of a predetermined diameter without prematurely handing up or prematurely causing the slips to actuate and grip the well string, while permitting such arrangement to be moved into an enlarged tubular portion of substantially greater diameter for thereafter radially expanding the slips in a manner to grippingly engage the enlarged section of the well bore casing.

DESCRIPTION OF THE PREFERRED EMBODIMENT

Figure 1:
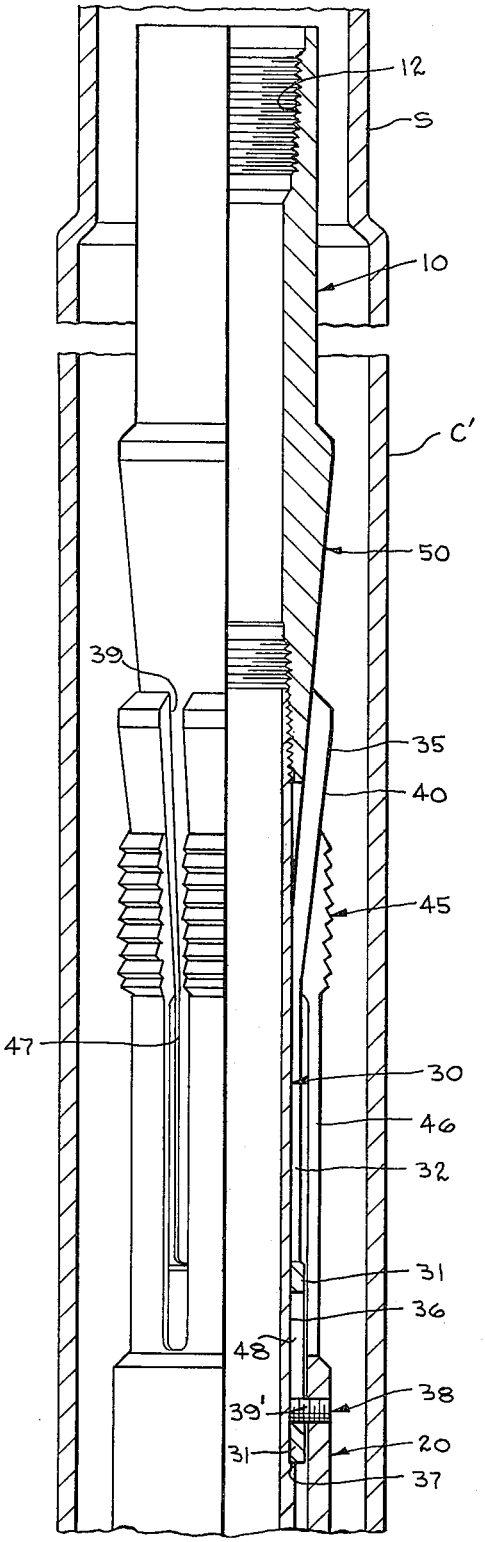
FIG. 1 is a vertical quarter sectional view illustrating the upper portion of the present invention positioned in a well string shown in half section.
Figure 5:
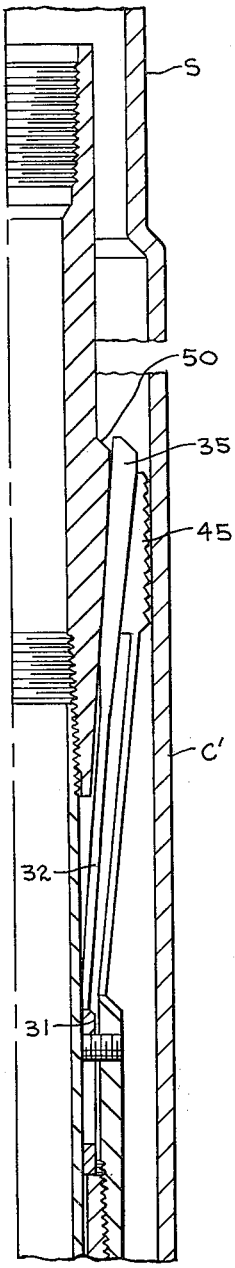
FIG. 5 is a sectional view similar to FIG. 3 but showing the slip segments, segmented cone means and cone shaped enlargement in position when the slip segments have been radially expanded to engage with the enlarged tubular section.
Figure 6:
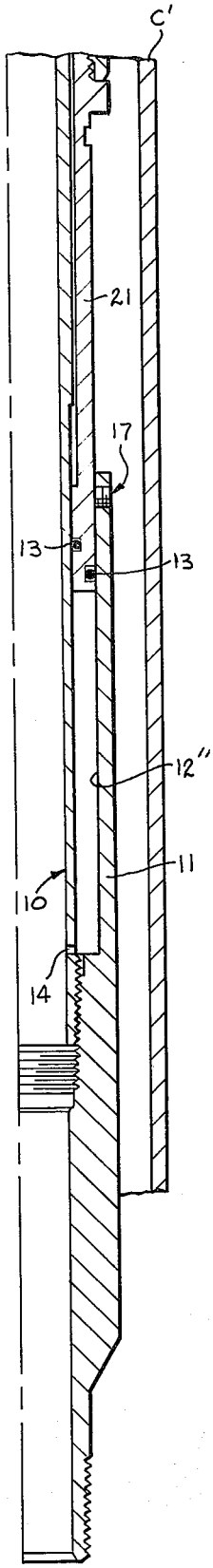
FIG. 6 is a partial sectional view similar to FIG. 4 but illustrating the final relationship of the components of the lower portion of the present invention when the slip segments are seated as shown in FIG. 5.

Attention is first directed to FIG. 1 of the drawings wherein a mandrel referred to generally at 10 is shown as being provided with threads 12 for connecting with a setting tool of a conventional type which extends to the earth's surface and enables the present invention to be lowered into the well bore along with a hanger secured by suitable means to the threads 12' at the other end of the mandrel 10. The setting tool and the hanger form no part of the present invention and are well known in the art so that no detailed description thereof is deemed necessary to an understanding of the operation of the present invention. An outer housing referred to generally at 20 is movably carried on the mandrel 10. Positioned between the mandrel 10 and outer housing 20 is the segmented cone means referred to generally by the numeral 30. The segmented cone means includes circumferentially spaced, enlarged portions 35 having tapered surfaces 40 thereon which cooperate with the slip segments 45 carried on the outer housing 40 and the cone shaped enlargement 50 to position the segmented slip means 45 radially into engagement with the enlarged casing portion C' as shown in FIG. 5.

Figure 2:
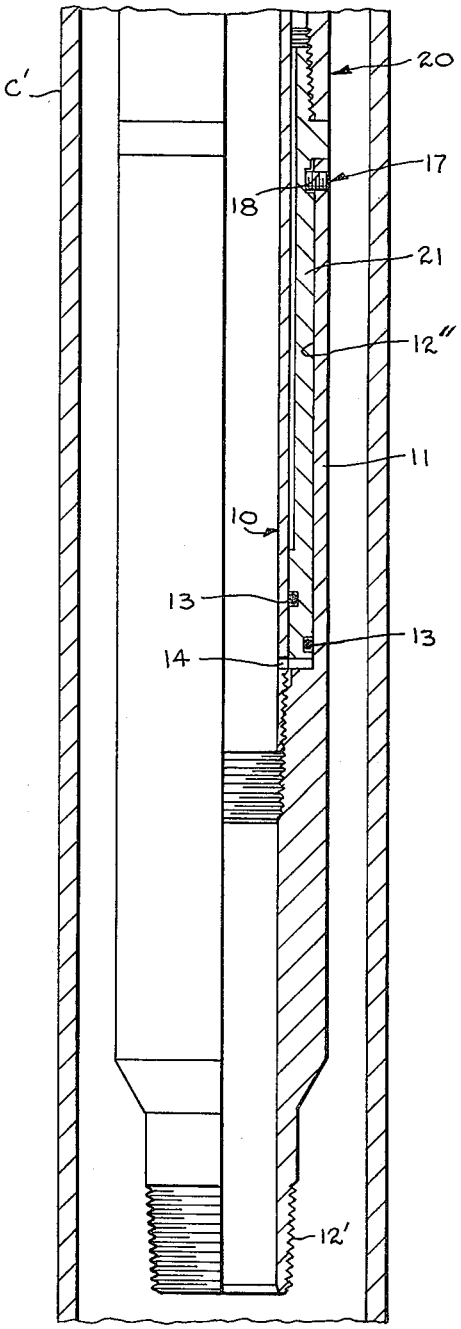
FIG. 2 is a continuation of the view shown in FIG. 1.

The mandrel 10 is formed of a plurality of tubular sections which may be threadedly connected together as illustrated in the drawings and such mandrel includes an annular skirt portion 11 which is formed on one of the tubular sections and is spaced radially of the other tubular sections forming the mandrel as shown in FIG. 2 of the drawings to define an annular cylinder portion 12'' therebetween.

The outer housing 20 includes a piston portion 21 which extends into the annular cylinder 12'' as shown in FIG. 2 of the drawings and suitable seal means 13 are provided thereon for enabling the piston portion 21 of the housing 20 to sealably engage with the walls of the annular cylinder 12''.

Port means 14 are provided in the mandrel to conduct fluid from the mandrel 10 into the annular cylinder 12'' to act on the piston portion 21 in a manner as will be described.

Suitable shear means referred to at 17 are provided or connecting the mandrel 10 and housing 20 together as they are lowered into the well bore casing to prevent premature actuation of the slip means towards radial gripping action with the well bore casing. Such shear means 17 as illustrated in the drawings may comprise a shear pin 18 connecting the mandrel 10 and housing 20 together, thus preventing relative longitudinal movement between the mandrel 10 and the outer housing 20 until the shear pin 18 has been sheared.

The segmented cone means 30 includes an annular body 31 from which extend the longitudinal extensions 32 which terminate in the segmented cone means 35 having the tapered surfaces 40 thereon as shown in FIG. 1. The annular body 31 of the segmented cone means 30 is received on the annular recess 36 formed on the mandrel 10 which terminates in the shoulder 37 against which the annular body 31 abuts as shown in FIG. 1. Suitable means referred to generally at 38 are provided for preventing upward movement of the segmented cone means 30 until it is desired to actuate the tool in a desired manner to radially expand the slip segments 45 into gripping relationship with the casing. Such means includes the lug 39' which abuts the lower end of slot 48 to thus keep the cone means 30 from moving upwardly until the slip segments 45 move upwardly.

It will also be noted that the segmented cone means 30 includes a plurality of longitudinally extending, circumferentially spaced slots 39 which extend from a position spaced from the end of body 31 and intersect the other end of the segmented cone means adjacent the enlarged portions 35, thus enabling the segmented cone means 30 to expand radially when the present device is actuated to engage the slip means 45 with the well bore casing.

The slip means 45 are integrally formed with the body 20, therebeing a cylindrical portion 46 of smaller or thinner diameter than the cone means 30 or the adjacent body section with which such cylindrical section 46 is integrally formed, and such cylindrical section 46 is provided with longitudinally extending grooves 47 which intersect the end of such cylindrical section adjacent the cone means 45 as shown in the drawings.

The pin on lug 39′ extends from the housing 20 into the longitudinal slot 48 in the portion 31 of the segmented cone means and serves to maintain the slip segments 45 in longitudinal alignment with the tapered surfaces 40 of the enlarged portions 35. As the segmented cone means 30 expands when it moves up on cone shaped enlargement 50, the grooves 39 therebetween will become wider; however, the slip means 45 will remain aligned in position on such tapered surfaces and will not overlap the adjacent grooves 39′ by reason of pin 39 being engaged in slot 48.

The device of the present invention may be lowered through a tubular string S, of smaller diameter than the enlarged portion C′. When the present invention is positioned in an enlarged portion C′ as illustrated in FIGS. 3–6, the present invention may be actuated. In connection with the operation and actuation of the present invention, suitable means well known in the art are provided in the liner arrangement beneath the present invention so as to close off fluid flow therethrough whereby the fluid pressure within the mandrel 10 may be increased.

Figure 3:
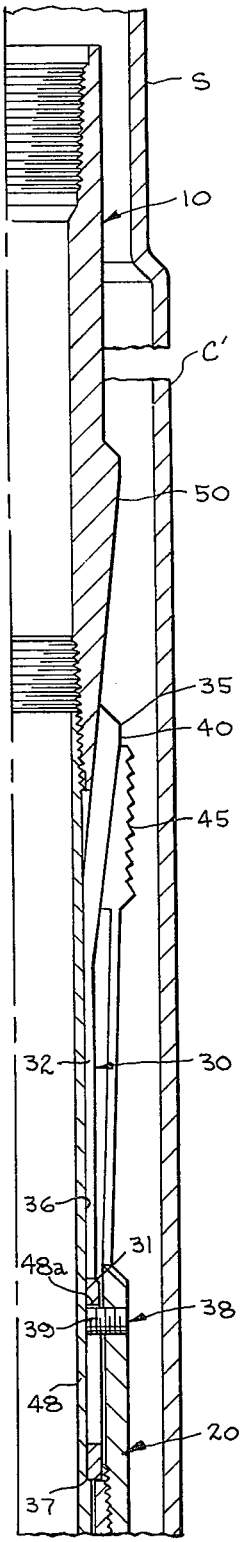
FIG. 3 is a partial sectional view showing the present invention positioned in an enlarged section of well bore casing or tubular member and in the initial phase of radially expanding the slips for gripping with such enlarged casing section.
Figure 4:
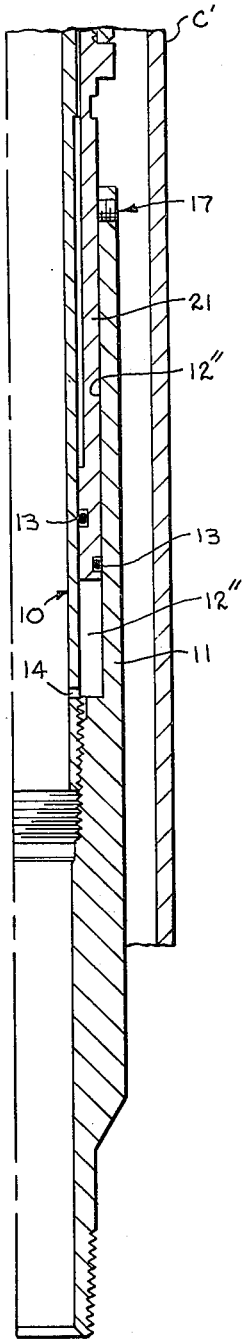
FIG. 4 is a partial sectional view similar to FIG. 3 and is a continuation of FIG. 3 showing the lower portion of the tool.

The fluid pressure is increased in mandrel 10 and such fluid pressure is exerted through port means 14 to act on the housing piston portion 21. The fluid pressure acting on housing piston 21 overcomes the shear means 17 whereupon the piston portion 21 may move longitudinally of the annular cylinder 11 as illustrated in FIG. 4 of the drawings. As the outer housing 20 including the piston portion 21 thereof is moved longitudinally of the mandrel 10 by fluid pressure, the slip segments 45 are urged upwardly and outwardly along the tapered surface 40 of the segmented cones 35. The movement of the outer body 20 relative to the mandrel 10 as well as relative movement to the segmented cone means 30 continues until the lug 39′ has moved the longitudinal extent of the groove 48 in the segmented cone means 30 until it engages the end 48*a* of such slot as illustrated in FIG. 3 of the drawings. When this occurs, continued fluid pressure applied through the mandrel 10 and the port means 14 forces the piston portion 21 of the outer housing 20 and the outer housing 20 longitudinally of the mandrel 10 so that the segmented cones 35 as well as the slip segments 45 move upwardly together on the cone shaped enlargement 50 on the mandrel 10 to the position shown in FIG. 5 of the drawings. When this occurs, the segmented slip means 45 has been urged into firm gripping relationship with the enlarged casing portion C′ so as to support the hanger and the arrangement therebeneath in a well known manner.

Thereafter, the setting tool used to lower the present invention in position, as well as the close off means in the liner beneath the present invention, to enable pressure to be built up in the present invention for actuation thereof, is retrieved in a manner well known in the art.

The release of the setting tool as well as the close off means and the operation thereof being well known to those skilled in the art will not be repeated herein.

From the foregoing, it can be seen that the present invention provides an arrangement to enable a liner and its setting and supporting arrangement to be lowered through a portion of a well bore casing or tubular string S which is of a smaller diameter than that in which the liner hanger is to be set. When the enlarged portion of the casing represented at C′ is reached, the present invention may be actuated as described to cause the slip means to move radially into gripping relation with the casing C′ for setting and supporting the hanger extending therebeneath in position in the well bore.

The foregoing disclosure and description of the invention are illustrative and explanatory thereof, and various changes in the size, shape, and materials as well as in the details of the illustrated construction may be made without departing from the spirit of the invention.

What is claimed is:

1. An arrangement for setting and supporting a liner in a well bore casing comprising:
   a. a tubular mandrel;
   b. an outer housing on said mandrel;
   c. a cone shaped enlargement on said mandrel;
   d. slip segments on said outer housing;
   e. segmented cone means slidably supported on said mandrel between said mandrel and outer housing;
   f. said mandrel including a portion spaced radially to define an annular cylinder and said outer housing having a piston portion sealably fitting in the annular cylinder;
   g. said mandrel having port means for communicating fluid pressure to act on said housing piston portion in the annular cylinder;
   h. shear means connecting said outer housing and said mandrel to restrain relative longitudinal movement therebetween, but releasable when a predetermined fluid pressure is applied through said mandrel port means to act on said housing piston portion whereby longitudinal movement of said outer housing relative to said mandrel engages said slip segments with said segmented cone means and said cone shaped enlargement to expand said slip segments into gripping engagement with the well bore casing.

2. The invention of claim 1 wherein said shear means consists of a shear pin.

3. The invention of claim 1 including cooperating means on said slip segments and segmented cene means for maintaining said slip segments and segmented cone means in a predetermined longitudinal alignment.

4. The invention of claim 3 wherein said cooperating means includes lug means on said outer housing engaged in slot means on said segmented cone means.

5. The invention of claim 1 including cooperating means on said outer housing and said segmented cone means to inhibit premature movement of said segmented cone means in a manner to radially expand said slip segments toward gripping engagement with the well casing.

* * * * *

UNITED STATES PATENT OFFICE

CERTIFICATE OF CORRECTION

Patent No. 3,999,605 Dated December 28, 1976

Inventor(s) Britt O. Braddick

It is certified that error appears in the above-identified patent and that said Letters Patent are hereby corrected as shown below:

Column 2, line 45, "or" should read -- for --.

Column 4, line 57, "cene" should read -- cone --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*